United States Patent [19]

Krider

[11] 4,074,929

[45] Feb. 21, 1978

[54] CABLE CARD EDGE CONNECTOR

[75] Inventor: Paul Robert Krider, Camp Hill, Pa.

[73] Assignee: AMP Incorporated, Harrisburg, Pa.

[21] Appl. No.: 392,728

[22] Filed: Aug. 29, 1973

[51] Int. Cl.[2] ..... H01R 9/08

[52] U.S. Cl. ..... 339/97 R; 339/103 R; 339/221 R

[58] Field of Search ..... 339/97–99, 339/103 R, 103 M, 220 R, 221 R, 221 M

[56] References Cited

U.S. PATENT DOCUMENTS

| | | | |
|---|---|---|---|
| 3,388,367 | 6/1968 | Brown | 339/97 P X |
| 3,403,372 | 9/1968 | Stinson | 339/97 R |
| 3,411,130 | 11/1968 | Bushey | 339/220 R X |
| 3,579,178 | 5/1971 | Travis | 339/221 R |
| 3,617,983 | 11/1971 | Patton | 339/98 |
| 3,750,091 | 7/1973 | Blackman et al. | 339/221 M |
| 3,760,335 | 9/1973 | Roberts | 339/99 R |
| 3,778,750 | 12/1973 | Caveney et al. | 339/97 R |

*Primary Examiner*—Lawrence J. Staab
*Attorney, Agent, or Firm*—Donald W. Phillion

[57] ABSTRACT

A card edge connector in which a plurality of conductors are terminated rapidly and simultaneously with a single, downward thrust of the conductors into the connector. A plurality of contacts are retained in the connector housing in a side-by-side, parallel relation. Each contact has a U-shaped portion opened at the trough of the U and with slots extending down in both legs of the U. A third slot, unique to each contact, exists in a vertically positioned panel of the housing. These three slots are aligned so that a conductor can be forced therein with a single, downward thrust of the conductor. The sides of one of the slots in the U is narrow and cuts through the conductor insulation and into the wire to make an electrical contact. The other slot in the U cuts into the insulation but not into the wire, thereby providing strain relief in two dimensions. The slot in the housing panel traps the conductor therein to provide strain relief in the third dimension.

3 Claims, 5 Drawing Figures

CABLE CARD EDGE CONNECTOR

BACKGROUND OF THE INVENTION

This invention relates generally to connector means and more specifically to a solderless connector within which a plurality of conductors can be terminated rapidly and simultaneously with a single downward thrust of the conductors and with a resultant strain relief in three dimensions.

A well known type of solderless connector comprises a contact means having a U-shaped portion therein. Slots are provided in each of the legs of the U. The trough of the U is open to permit the insertion of a conductor into the slots in the two legs of the U. One of the slots is narrower than the other and functions to cut through the insulation and press against the wire portion of the conductor with sufficient force to create a good electrical contact therewith. The said other slot is wider and functions to cut part way into the insulation of the conductor but not into the wire portion and to thereby provide a strain relief along the direction of the conductor. This type of contact means is commonly known as a customer applied contact means, deriving its name from the fact that the customer frequently buys the connector and inserts the conductors therein in his own plant facilities. One difficulty with this type of contact means is that no strain relief is provided along the vertical dimensions of the slots in the U-shaped portion of the contact. More specifically an upward force exerted on the conductor will tend to push the conductor out of the slots and thereby destroy the electrical connection. To provide strain relief in the vertical direction of the slots and thereby prevent unauthorized removal of the conductor from the slots, the prior art employs tabs which are integral with the contact means and which are capable of being folded over the conductor to hold it securely within the two slots. Such an arrangement produces a secure and reliable connection. However, the bending of the tabs over the conductor involves an additional increment of time in the installation of the conductor in the contact means. Although such increment of time is very small in the case of installation of a single conductor, it becomes very substantial when millions of conductors are involved. Furthermore, if it is desired to remove a conductor from the contact means it is necessary to unbend the tabs. Another disadvantage of the use of tabs involves the amount of material in manufacturing the contacts. The contacts are usually fabricated from a continuous strip of flat stock material from which the blanks are stamped and then formed into the finished contacts. The need for tabs which extend transversely out from the body of the conductor involves substantially more material than is required for similar blanks without tabs. While the additional material required for a single contact is small such additional material becomes very substantial when millions of contacts are involved.

A primary object of the invention is a simplified customer applied solderless connector means in which a plurality of conductors can be rapidly and simultaneously terminated with three dimensional strain relief characteristics.

A second purpose of the invention is a solderless connector means constructed to terminate one or more conductors by inserting said conductors into said connector means by a single application of force in one direction only.

The third aim of the invention is a solderless connector means for terminating at least one conductor by a single applied force applied in one direction only in such a manner that said conductor will resist removal from said connector in all directions.

A fourth object of the invention is the improvement of customer applied solderless connectors, generally.

BRIEF STATEMENT OF THE INVENTION

In accordance with the invention there is provided a connector having an insulative housing comprising a flat base or bed panel partitioning walls formed perpendicularly thereon. A plurality of contact means are retained in said housing between said partitioning walls in a parallel, side-by-side relation. Each of the contact means comprises a U-shaped portion with slots formed in both legs of the U and parallel with the longitudinal direction of said legs of the U. The trough of the U is open to permit the insertion of the conductors down into the slots in the two legs of the U. One of the two slots is narrower than the other and functions to cut through the insulation and into the wire in order to make good electrical connection therewith. The other slot functions to cut only slightly into the insulative material of the conductor to thereby grip said conductor and provide strain relief along the longitudinal direction of the conductor.

The plastic insulating housing contains a vertical panel section which extends across the front of the row of contact means. A plurality of slots are formed in said panel, one slot of each contact means. Preferably, each of these panel slots is aligned substantially with the two slots in the two legs of the cooperating contact means. Further the opening in said panel slot is aligned with the openings of said two slots in the two legs of the cooperating contact means near said first end of said contact means so that a conductor can be inserted into all three slots simultaneously and with one downward thrust of the conductor. The edges of the slots in the housing panel are configured to permit easy entry of a conductor therein but to prevent unauthorized removal therefrom. At the other end of said contact means there is provided a tab which extends slightly over the edge of the housing.

It is to be specifically noted that several conductors can be inserted simultaneously into the two slots in the two legs of the U-shaped portion of the cooperating contact means and also into the corresponding slot of the housing panel with a single, simultaneously unidirectional motion of all the conductors.

A feature of the invention is that the inserted conductors have strain relief in all three dimensions. More specifically, the wider slot in the one of the legs of the U provides strain relief means along the longitudinal direction of the conductor, and the slot in the housing panel provide strain relief in any direction in a plane perpendicular to the conductor trapped therein.

BRIEF DESCRIPTION OF THE DRAWINGS

The above-mentioned and other objects and features of the invention will be more fully understood from the following detailed description thereof when read in conjunction with the drawings in which.

DESCRIPTION OF THE INVENTION

Figure 1:
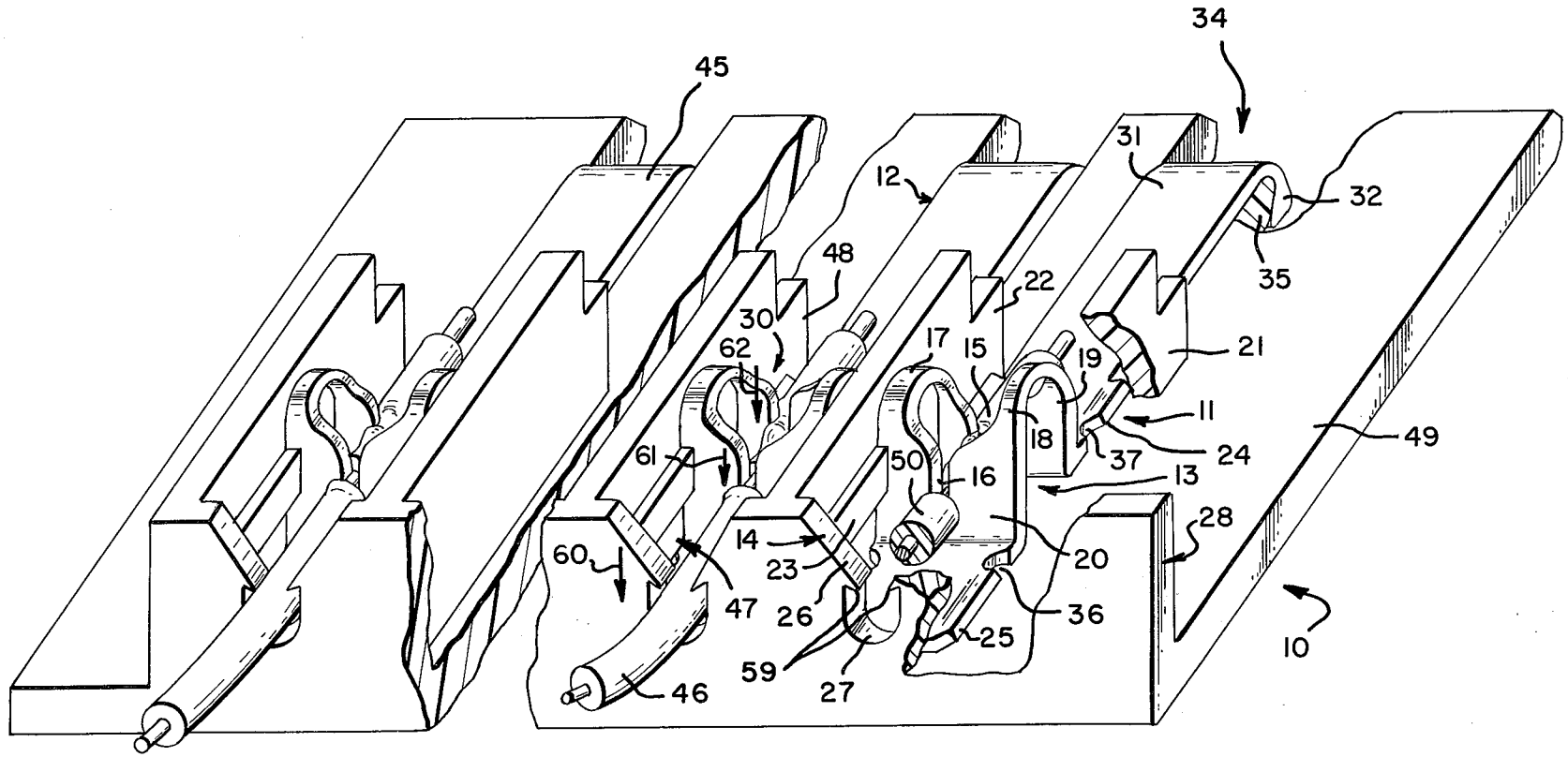
FIG. 1 is a perspective view of the connector with portions of the housing broken away to disclose one of the contacts held therein and the relationship of said contact with said housing.

Referring now to FIG. 1 there is shown the housing 10 upon which is mounted three contact means 11, 12 and 45. It is to be understood that the housing 10 can retain additional contact means.

The housing 10 is comprised of a base or bed portion 49 upon which the contact means, such as contacts 11 and 12 are mounted. Partitioning walls, such as walls 21, 22 and 48 separate the contacts from one another and also provide means by which the contact means are retained in the bed of the connector housing 10. More specifically, the contact means such as contact 11 are held between the adjacent partitioning walls such as walls 21 and 22 by a friction fit. The edges of the contact 11 such as edges 25 and 24 are bent slightly upward to allow the contact means 11 to be easily pushed down into its slot in the housing 10 but severely impedes the extraction of contact 11 from between partitioning walls 21 and 22. The cut-out portions 36 and 37 in contact means 11 permit the bending of the edges 25 and 34 of contact 11 without distorting the rest of said contact means 11.

A front plate 28 extends across the front of the housing and contains a series of wire trapping slots such as slots 47 and 14. Each of these slots 47 and 14 has a configuration such that a conductor, such as conductor 46 can be easily inserted down into the slot 47 but cannot be easily extracted therefrom. For example, barbs such as barbs 59 will retain a conductor inserted in slot 14. In this manner the slots, 47 and 14 for example, function as strain relief means in all directions in the plane of the plate 28, which plane is perpendicular to conductor 46.

Each of the contacts such as contact 11 has a U-shaped portion, denoted generally by reference character 13 in FIG. 1. This U-shaped element has two leg portions 19 and 20 into which there is formed a pair of slots 15 and 16. The transverse or trough portion of the U-shaped element 13 is removed to permit a wire or conductor 50 to be insertd down into the slots 15 and 16. The conductor 46 is shown as being inserted in the corresponding slots of U-shaped portion 30 of the adjacent contact means 12.

Each slot of each pair of slots, such as slots 16 and 15, have different widths and perform different functions. More specifically, the slot 16 narrower than the slot 15 and functions to cut not only through the insulation of the conductor inserted therethrough, but also into the wire portion of the conductor a sufficient amount to establish a good electrical contact with said wire portion. The wider rear slot 15 functions as a strain relief mechanism. More specifically, slot 15 will cut into the insulative portion of a conductor but will not cut through said insulation portion and into the wire portion. Thus the slot 15 grips the conductor 50 and functions as a strain relief means in the direction of the wire, as well as transverse to the conductor and the U-shaped element 19. However, it is evident from FIG. 1 that it would be possible to extract the wire 50 from the slots 15 and 16 by an upward force. Such an upward force could be generated, for example, by vibrations to which the connector might be subjected.

It is to prevent the accidental removal of the conductor 50 from the slots 15 and 16 that the wire trapping slots, such as slot 14 in panel 28, is provided. The distance between panel 28 and slots 16 and 15 in U-shaped portion 13 is sufficiently small compared to the diameter of the conductor 50 that said conductor 50 is effectively held in slots 15 and 16.

It is to be noted that the three slots 15, 16 and 14 are aligned with each other and all are open at the top, as shown in FIG. 1. Accordingly, a conductor can be inserted in all three slots 15, 16 and 14 simultaneously by a single downward thrust of the conductor, which previously has been positioned across the top entrances to the slots 15, 16 and 14.

In point of fact, conductors can simultaneously be positioned across the top of each grouping of three slots, i.e. the two slots in the U-shaped portion of a connector means, and the corresponding slot in the panel 28. Then all of said conductors simultaneously can be pressed downward into the three slots below them to effect a very rapid connection of the conductors into the contact means therebelow.

The actual insertion of a conductor, such as conductor 46 in a connector such as connector 12, is effected by applying force in the direction and location of the arrows 60, 61 and 62 in FIG. 1.

It is this facility of rapid connection of a plurality of conductors simultaneously in the connector, with a resulting strain relief in all directions, that much of the value of the invention lies. It is to be understood that while the invention does not lie in the method of making the connections between the conductors and the connector, it is because such a method can be applied to the particular configuration of the invention that said particular configuration is new and of considerable utility.

It is also to be noted that the U-shaped element can be replaced with any structure that provides in essence, two legs that extend vertically upward from the bed 49 of the connector housing and have vertically aligned slots therein. The use of the U configuration provides obvious fabrication advantages and also provides structural strength to the contact. Other configurations, however, are also feasible.

Figure 2:
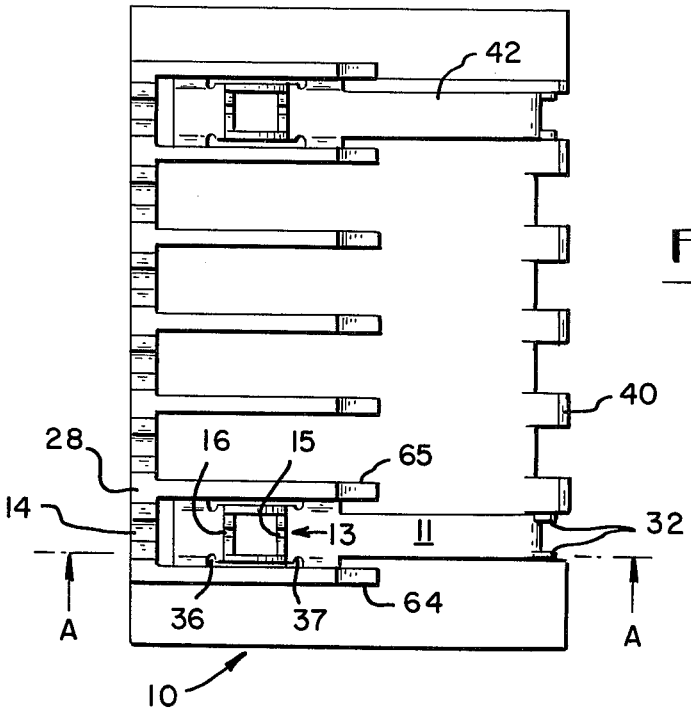
FIG. 2 is a top plan view of the connector with two contact means retained therein.

Referring now to FIG. 2 there is shown a plan view of a housing capable of retaining six contacts. However, only two contacts 11 and 42 are shown as being inserted in said housing 10 in FIG. 2. The alignment of slots 15 and 16 of U-shaped element 13 with the slot 14 in panel 28 of housing 28 can also be seen in FIG. 2. Further, the friction fit of contact 11 in the slot between partitions 21 and 22 can be seen.

Figure 3:
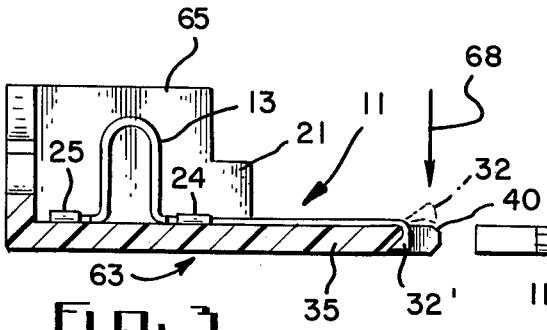
FIG. 3 is a side view of the structure of FIG. 2.
Figure 5:
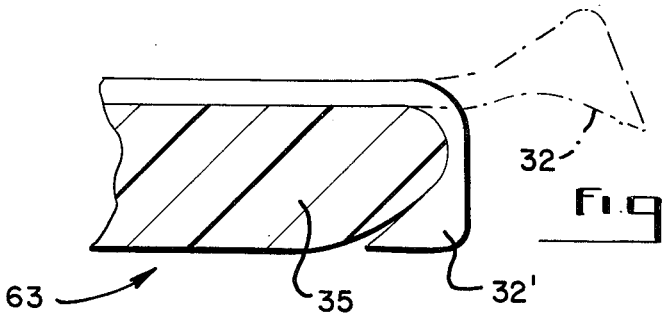
FIG. 5 is a detailed showing how one end of the contact means is secured to the connector housing.

At the right hand end of contact 11 in FIG. 2 there is shown the top view of two ear-like elements 32. A side view of these two ears is shown in FIG. 3. The function of these two ears 32 is to provide a means of securing the right hand end of contact 11 to the housing 10. More specifically, because of the configuration of the ears 32, they are shaped to respond to a downward thrust of a tool (not shown) in the direction indicated by the arrow 68 to become folded under the end 35 of the housing 10 and assume the position indicated by reference character 32' in FIG. 3. An enlarged view of the end 35 of housing 10 with the ears 32' folded thereunder is shown in FIG. 5.

Referring again to FIG. 3 there is shown a side view of the elements 25 and 24 which, as can be seen from FIG. 1, comprise the bent-up edges of contact means 11, and function to enable easy entry of contact means 11 down between the partitioning walls 21 and 22, but also function to prevent extraction of said contact 11 from said partitions 21 and 22.

Figure 4:
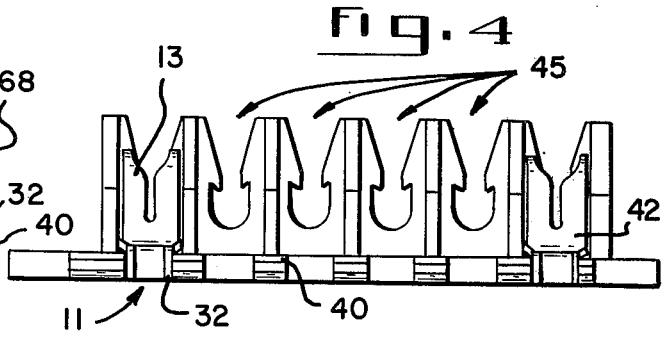
FIG. 4 is an end view of the structure of FIG. 2.

Referring now to FIG. 4, the configuration of the slots 45 can easily be seen. Also shown are end views of the two contact means 11 and 42 positioned at the two extreme ends of the connector 10 and the end view of the ears 32. Also, the beveled edge 40 of the connector 10 is shown. These beveled edges 40, also shown in the top plan view of FIG. 2, perform the function of facilitating easy entry of the connector into a mother board card edge connector (not shown).

It is to be understood that the form of the invention shown and described herein is but a preferred embodiment thereof and that various changes may be made in configuration, both of the contact means and the insulating housing, without departing from the spirit and scope of the invention.

What is claimed is:

1. A card edge connector comprising:

a plurality of contact means;

a housing means having a flat bed with a front edge and a rear edge, and constructed to retain said plurality of contact means in a side-by-side parallel relationship with each other in said housing means;

each of said contact means constructed to receive and retain a conductor and comprising:

a U-shaped element with the two legs of the U having a width dimension normal to the plane of the U and with a first slot formed longitudinally in the width dimension of a first of said two legs of the U and a second slot formed longitudinally in the width dimension of the second of said two legs, and further with a slot formed across the trough of said U joining together said first and second slots;

said first slot having a width calculated to cut through the insulation of a conductor inserted therein and to press into the conductive portion of said conductor with sufficient force to make good electrical contact therewith;

said second slot having a width calculated to cut into the insulation only of a conductor inserted therein;

each of said contacts further comprising a strip-like element which extends to the rear edge of said flat bed and is secured at said rear edge to said flat bed;

the said housing means comprises means defining a plurality of first partitions mounted upon said flat bed and positioned between said contact means;

said housing means further comprising a plurality of second partitions substantially perpendicular to the retained conductors and mounted upon said flat bed adjacent said U-shaped element and having a plurality of conductor trapping slots therein, with each conductor trapping slot being substantially aligned with the first and second slots of a given U-shaped element to enable a conductor to be inserted into said first and second slots and also into said conductor trapping slot in substantially parallel directions of motion;

each of said conductor trapping slots having its inner edge formed to facilitate insertion of a conductor therein and to impede the extraction of a conductor therefrom;

said first slot in each of said U-shaped elements being positioned between said second slot in each of said U-shaped elements and the said conductor trapping locking slot aligned therewith.

2. A card edge connector comprising:

a housing means comprising a flat bed having a front edge and a rear edge;

a plurality of contact means retained in a side-by-side parallel arrangement on said flat bed in said housing means with each contact means constructed to receive and to retain a conductor and with each contact means comprising:

a U-shaped portion having a slot beginning in the trough section of said U-shaped portion and extending around said U into the first and second legs of said U-shaped portion;

said slot in said first leg having a width calculated to cut through the insulation of said conductor when inserted therein and to cold work the conductive portion of said wire into a generally oval shape to make good electrical contact therewith; and said slot in said second leg having a width calculated to grip the insulation only of said conductor when inserted therein;

a strip-like portion extending from said U-shaped portion to the rear edge of said flat bed with the end thereof secured to said rear edge of said flat bed;

the said housing means comprising means defining a plurality of first partitions mounted vertically upon said flat bed between said adjacent contact means;

said housing means further comprising a plurality of second partitions mounted upon said flat bed substantially perpendicularly to the conductors retained in said contact means and adjacent said U-shaped portions of said plurality of contact means, and having a plurality of conductor locking slots therein, with each conductor locking slot being substantially parallel with the slots in a given U-shaped portion and positioned to receive the conductor which is inserted in the slots of said given U-shaped portion;

each of said conductor locking slots having the inner edge thereof formed to enable the admission of a conductor therein and to impede the extraction of said conductor therefrom;

said slot in said first leg of each of said U-shaped portions being positioned between said slot in said second leg of each of said U-shaped portions and the said conductor locking slot positioned parallel therewith.

3. A card edge connector comprising:

a housing means having a flat bed;

a plurality of contact means individually retained in and mounted upon the bed of said housing means with each contact means constructed to receive and to retain a conductor and with each contact means comprising:

first and second rectangularly shaped members extended upward vertically from said housing bed and in planes normal to the conductors to be retained therein;

each of said rectangularly shaped members having a vertically positioned slot, open at the top, formed therein;

said slot in said first member constructed to cut through the insulation of the conductor inserted therein and to press into the conductive portion of said conductor to make good electrical contact therewith; and said slot in said second member constructed to grip the insulation only of the conductor inserted therein;

the said housing means constructed to define therein a plurality of first partitions mounted substantially vertically upon said flat bed and positioned between said adjacent contact means;

the said housing means further comprising a plurality of second partitions mounted vertically upon said flat bed and mounted substantially perpendicular to said first partitions and having a plurality of conductor locking slots each parallel to the slots in a given pair of said first and second members; and with each conductor locking slot being positioned to receive the conductor inserted in the slots of the associated given pair of said first and second members;

each of said conductor locking slots constructed to enable the insertion of a conductor therein and to impede the extraction of said conductor therefrom;

said slot in said first rectangularly shaped member being positioned between said slot in said second rectangularly shaped member and the said conductor locking slot positioned parallel therewith.

* * * * *